United States Patent [19]

Player

[11] 4,425,747

[45] Jan. 17, 1984

[54] TWIN-VEE CEILING HANGER CLIP

[75] Inventor: Wayne H. Player, Mesquite, Tex.

[73] Assignee: Howmet Aluminum Corp., N.Y.

[21] Appl. No.: 275,605

[22] Filed: Jun. 22, 1981

[51] Int. Cl.[3] ..... E04B 1/74

[52] U.S. Cl. ..... 52/404; 52/508; 52/522; 52/529; 52/544; 52/552; 52/713; 52/714; 52/773

[58] Field of Search ..... 52/404, 407, 478, 508, 52/536, 537, 542, 543, 545, 568, 714, 522, 529, 544, 552, 713, 773; 248/72, 225.3 A, 228, 317

[56] References Cited

U.S. PATENT DOCUMENTS

| | | | |
|---|---|---|---|
| 3,204,383 | 9/1965 | Adams | 52/404 |
| 3,590,543 | 7/1971 | Heirich | 52/478 |
| 4,155,206 | 5/1979 | Player | 52/478 X |
| 4,285,182 | 8/1981 | Dinges | 52/543 X |

FOREIGN PATENT DOCUMENTS

| | | | |
|---|---|---|---|
| 75073 | 6/1954 | Netherlands | 52/478 |

*Primary Examiner*—Alfred C. Perham

*Assistant Examiner*—David J. Thomas

*Attorney, Agent, or Firm*—Thomas L. Cantrell; Joseph H. Schley; Stanley R. Moore

[57] ABSTRACT

The present invention provides an apparatus and a method for insulating a covered patio by supporting insulation upon ceiling panels depending from clamps engaged in the apices of a twin-vee roof. The roof engaging elements of the clamp include a diagonal face plate with a gripping extended edge and a set screw threadedly engaged through said diagonal face plate. These elements are disposed so that the gripping edge of the diagonal plate and the leading edge of the set screw engage opposite vertical faces of the receiving slot at an apex of a roofing panel. The head of the set screw is accessible when the clamp is in place and tightening the set screw secures the clamp to the roofing panels and lodges the clamp in place by establishing sufficient force to the opposing walls adjacent the closed top of the slot. The depending end of the clamp carries mean of connection with the ceiling panels and this connection establishes the cavity into which the insulation is placed.

7 Claims, 3 Drawing Figures

TWIN-VEE CEILING HANGER CLIP

BACKGROUND

It is currently a popular practice to enlcose existing covered patios of residential construction in order to add a sun room or a small room of some other utility. However, rising energy costs have radically changed the economic practicalities of enclosing patios to establish rooms of year-round use in all but the most moderate of climates. This change mandates that the enclosed areas be provided with some insulation and one of the greatest, as well as least necessary, losses is through the ceilings of these rooms where the room is converted from a covered patio simply by adding windows or walls to the existing roof. The popularity of patio conversions and the need for insulating the ceilings of these enclosures have combined to create a demand for a insulation system compatible with the common existing roofs of covered patios and of earlier conversions not yet insulated. These non-insulated roofs are typically constructed of "twin-vee" panels.

Thus the real need is for a system which is compatible with twin-vee roof panels already in place. The system should provide for easily forming a cavity between the existing roof and a suspended ceiling into which insulation is placed and should securely support the insulation and the ceiling. Further, the ceiling support members should easily interface with the existing roof, attaching without the need for special tools, without placing holes through the roof, and without supporting framework that would drop the already low ceiling materially below the level required by the desired depth of insulation.

SUMMARY OF THE INVENTION

The present invention provides an apparatus and a method for insulating a covered patio by supporting insulation upon ceiling panels depending from clamps engaged in the apices of a twin-vee roof. The apices of the twin-vee configuration are closed longitudinal slots having substantially vertical walls. Further, twin-vee panels themselves interconnect at alternate ribs with overlapping flanges. And at these slots a re-entering angle of the inside flange alters one of the vertical walls of the slot by providing a slight longitudinal recess and an adjacent projection. This recess and projection are utilized at the apices of roofing panel interconnection to form a particularly secure clamp to roof connection.

The roof engaging elements of the clamp include a diagonal face plate with a gripping extended edge and a set screw threadingly engaged through said diagonal face plate. These elements are disposed so that the gripping edge of the diagonal plate and the leading edge of the set screw engage opposite vertical faces of the receiving slot at an apex of a roofing panel. The head of the set screw is accessible when the clamp is in place and tightening the set screw secures the clamp to the roofing panels and lodges the clamp in place by establishing sufficient force to the opposing walls adjacent the closed top of the slot.

The depending end of the clamp carries means of connection with the ceiling panels and this connection establishes the cavity into which the insulation is placed. The ceiling panels also provide the visible finishing in the completed room.

In a particularly effective embodiment of the connection system, the depending clamp divides into a bifurcated set of clip rail engaging gripping elements. Clip rails are then snapped into place transverse to the roofing panels between the gripping members of a plurality of aligned clamps. The rails carry cushioned beads and the rails are pushed into engagement with the clamps until the cushioned bead is held into contact with the lower-most surface of the troughs of the roofing panels. Secure against the roofing panels and within the clamps, the clip is ready to receive suspension clips within longitudinal receiving tracks on the underside of the rail. One end of the suspension clip extends horizontally and this is threaded into the track where it is securely suspended, yet slidably fixed. The depending end of the suspension clip is trifurcated with two vertical extensions on either side of a cantilevered spring prong. This depending clip end receives the lateral edges of the ceiling panel between the vertical extensions and the prong which, together, secure the ceiling to the roof. This clip and track arrangement allows greater latitude in the alignment of the ceiling panels to the roofing panels and allows less stressful relative displacement due to varying thermal expansions of the roof and ceiling.

Insulation is placed between the roof and the suspended ceiling where it is supported by the ceiling panels without further structural support.

DETAILED DESCRIPTION

Figure 1:
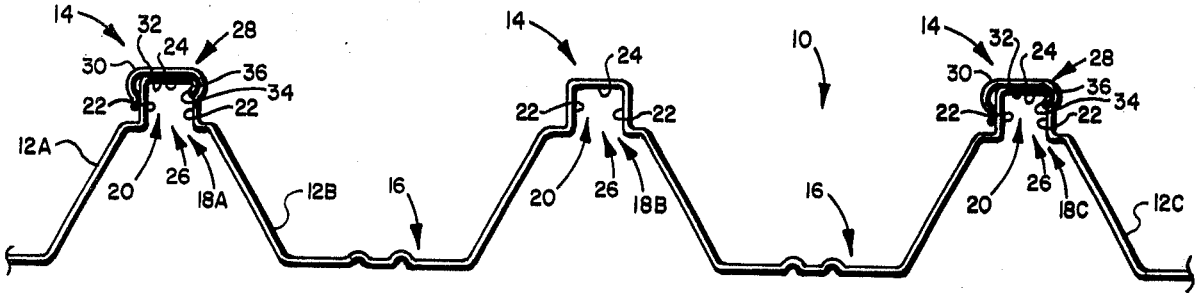
FIG. 1 is a cross-section of a conventional twin-vee roofing system.

FIG. 1 illustrates a cross section of a twin-vee roofing configuration commonly used to cover patios, see generally roof 10. Twin-vee roof 10 is formed of roofing panels 12 which are fashioned into alternating ribs 14 and troughs 16. The illustrated section of roof 10 incorporates portions of three panels, designated 12A, 12B and 12C, here shown connected together as they would appear in a standard roof before insulation. The illustrated segment of roof 10 has three ribs 14 and the underside of each of these ribs rises to an apex 18. Thus three apices, here 18A, 18B and 18C are illustrated in FIG. 1. Each of apices 18 has the general configuration of a slot 20 having substantially vertical walls 22, a closed top 24, an open bottom 26, and each runs the length of the panel.

Insulation is placed between the roof and the suspended ceiling where it is supported by the ceiling panels without further structural support.

Apices 18A and 18C are formed by the interconnection of roofing panels 12A and 12C, respectively, to roofing panel 12B on opposing sides thereof. Joints 28 formed at these interconnections are fastened and sealed by outside flanges 30, here carried on panels 12B and 12C, wrapping about inside flanges 32, here carried on panels 12A and 12B. The leading edge of the inside flanges form projections 34 which are curled to a re-entrant angle that aids in engaging the outside flange about them. Further, inside flanges 32 are extended slightly where they engage a recess in the outer flange 30 and this extension presents a recess 36 in one of vertical walls 22 in slot 20. This recess and projection combination runs the length of the joined panels and although merely a slight channel-like irregularity in the symmetry of an uninsulated twin-vee roof, the present invention is hereinafter shown to effectively utilize this incidental irregularity to securely depend the insulation and ceiling.

Figure 2:
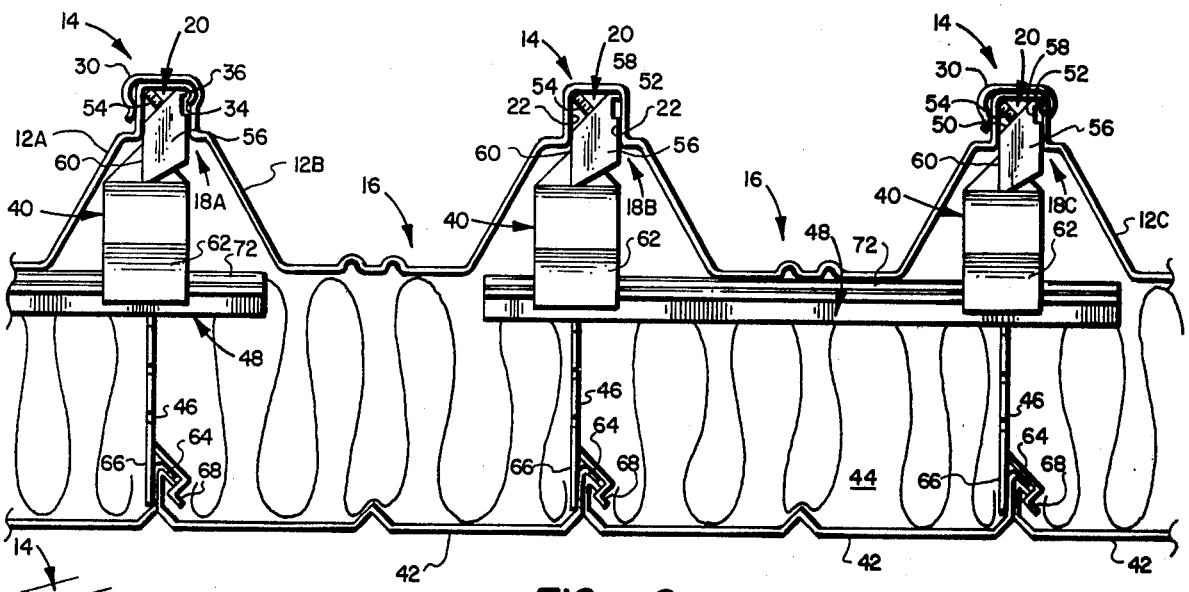
FIG. 2 is a cross-section of a twin-vee roofing system that has been provided with insulation in accordance with the present invention.

FIG. 2 is a cross-section of the twin-vee roofing system 10 to which an insulation system has been added. Clamps 40 seat in slots 20 of apices 18 and these clamps provide the support for ceiling panels 42. Insulation 44 is disposed in the cavity created between ceiling panels 42 and roofing panels 12. In the prefered embodiment, the ceiling panels are connected to clamps 40 through suspension clips 46 and clip rails 48.

The roof engaging end of clamp 40 carries a diagonal plate 50 having an extended leading or engaging edge 52. Further, set screw 54 projects upward through diagonal plate 50 through which it is threadedly engaged. In the prefered embodiment diagonal plate 50 is skirted with reinforcing side plates 56 which have notches 58 immediately below engaging edge 52 of diagonal plate 50. These side plates strengthen the angular integrity of the diagonal plate by stablizing the connection of the diagonal plate through front plate 60 to body 62 of clamp 40.

Notches 58 in the side of plates 56 allow the exploitation of the recess 36-projection 34 combinations available at apices 18A and 18C of FIG. 2 where panels 12A and 12B, and 12B and 12C are interconnected.

The seating at an interconnection apex such as apices 18A and 18C is much more secure because engaging edge 52 of diagonal plate 50 projects into recess 36 and rests upon projection 34. Set screw 54 is tightened against the slot wall opposite the recess-projection and presses the engaging edge of the diagonal plate into secure engagement. The smoother vertical walls of the slot in apex 18B do not offer any irregularities such as the recess-projection combination of apices 18A and 18B, nevertheless the set-screw and the engaging edge of diagonal plate 50 sustains sufficient pressure against the opposing slot walls 22 to retain a fully loaded clamp 40 in place.

The preferred embodiment illustrated in FIG. 2 uses clip rails 48 attached to the body of clamps 40. These rail clips run transverse to ribs 14 of roofing 10 and are held tightly against trough 16 of roofing 10 by clamps 40. Suspension clips 46 depend from tracks 76 formed in the underside of clip rails 48 where they are slidably engaged and the suspended end grasps flanges 64 of ceiling panels 42 between extensions 66 and prong 68.

Thus, the ceiling is suspended from the roofing and the space therebetween receives insulation and in this manner an existing patio roof is effectively utilized in the conversion of a covered patio into an enclosed room.

Figure 3:
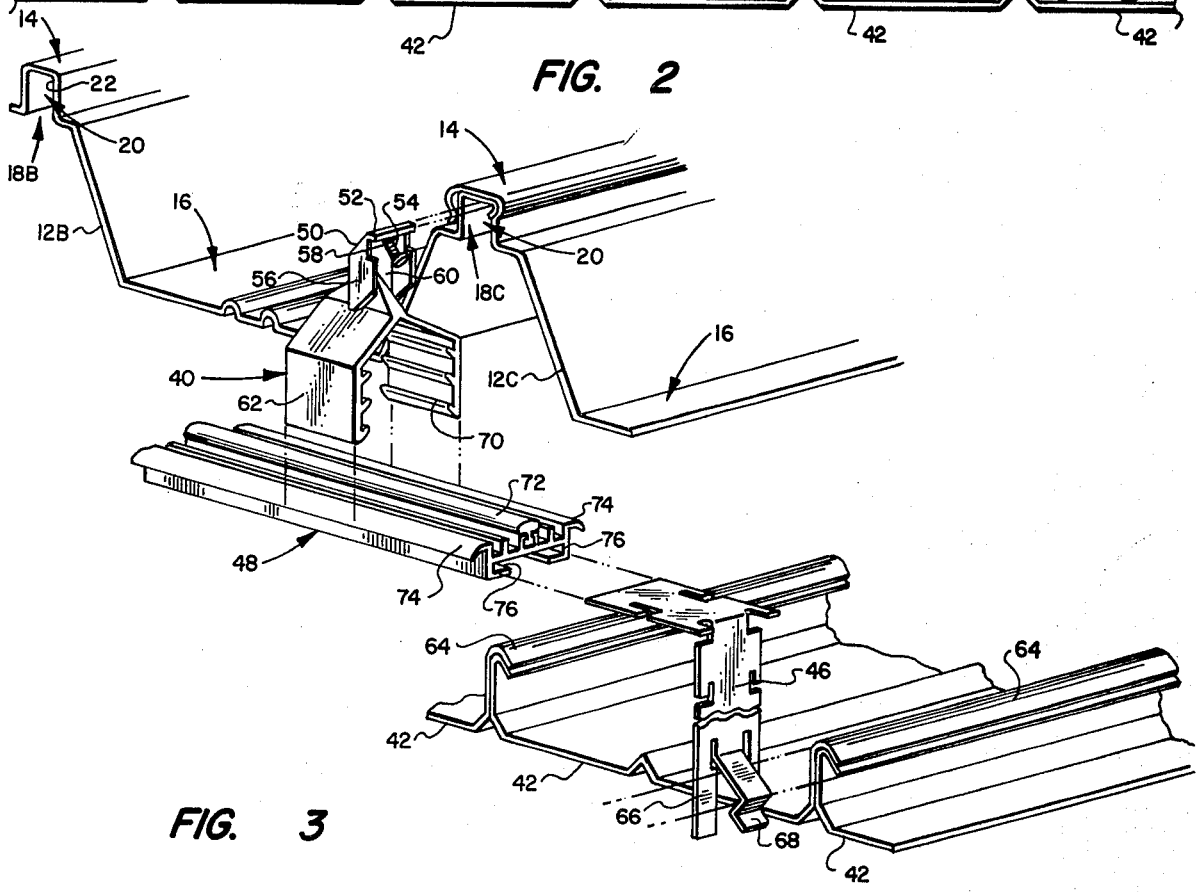
FIG. 3 is an exploded perspective view of a twin-vee roofing system that has been provided to enclose insulation in accordance with the present invention.

FIG. 3 is an exploded view of the present invention illustrating the separated elements in a perspective view. This Figure is particularly useful in teaching the prefered embodiment of clamp 40. Note the reinforcement to diagonal plate 50 by side plates 56 in the connection of these and front plate 60 to main body 62 of the clamp, here a bifurated array of opposing rail engaging daggers 70. Note also the accessability of set screw 54 between side plates 56.

The first step in insulating a previously installed twin-vee roof is the installation of clamps 40 into apices 18. The clamps are aligned into series of sets that run beneath roof 10 transverse to ribs 14 and troughs 16. The clamps are simply held in place while set screws 54 are tightened. Clip rails 48 are then lifted into engagement with the series of aligned clamps where they are received between the bifurcated dagger carrying sides of body 62 of each clamp. These daggers allow the clip rail to be pushed into engagement with clamp 40 until cushion bead 72 is pressed firmly against the underside of troughes 16 between clamps 40. The upward pressure against the clip rail is then released and flanges 74 of clip rail 48 fall into daggers 70. Daggers 70 are disposed to allow upward passage of the clip rail but engage flanges 74 to prevent withdrawal and the clip rail is secured in this engagement by gravity and the resilience in compressed cushion bead 72.

The underside of the mounted clip rails 48 present longitudinal tracks 76 which slidably receive suspension clips 46. A number of suspension clips are slid into tracks 76 to correspond to the lateral edges of adjacent ceiling panels 42. Ceiling panels 42 are arranged parallel to roofing panels 12 and transverse to the slidable freedom of the clip rails and this freedom allows some latitude in alignment of ceiling panels beneath the roofing panels during installation. The ceiling panels in FIGS. 2 and 3 are installed from left to right. A ceiling panel is lifted into place, suspension clips are aligned to receive it, and flanges 64 of the ceiling panels are pushed into engagement between extensions 66 and prong 68 on the depending end of suspension clip 46. Insulation is then inserted into the cavity created between the roof and the installed ceiling panel. The next ceiling panel is similarly installed and its adjoining lateral edge carries a flange 64 which nests within flange 64 of the last previously installed panel. Insulation is then inserted between the roof and the panel and the process is repeated across the conventional room.

In this manner, the twin-vee ceiling is economically and conveniently provided with insulation without using special tools or placing holes in the roof.

I claim:

1. An insulation system for use with a twin-vee patio type roof having longitudinal panels with alternating longitudinal ribs and troughs, said ribs rising to apices having downwardly open longitudinal slots with substantially vertical walls, said insulation system comprising:

ceiling panels;

at least one clamp having a main body and a roof engaging end;

said roof engaging end of said clamp comprising:

a diagonal plate;

an extended engaging edge on said diagonal plate;

and a set screw threadingly engaged through said diagonal plate;

said extending engaging edge and said set screw engage opposite walls of said slot at an apex of said twin-vee roof, thereby securely lodging said clamp to the underside of said roof;

means for connecting said main body of said clamp to said ceiling panels said ceiling panels being suspended from said roof through said clamps, thereby creating a cavity between said roof and said ceiling panels;

insulation placed within said cavity between said roof and said ceiling panels

2. An insulation system in accordance with claim 1 wherein said means for connecting said main body of said clamp to said ceiling panels comprises:

a clip rail;

means for connecting said clip rail to said clamp;

tracks on the underside of said clip rail;

at least one suspension clip having a first end slidably engagable in said tracks and a second end depending therefrom; and means for securing said ceiling panels to said second end of said suspension clip.

3. A insulation system in accordance with claim 2 wherein said means for connecting said clip rail to said clamp comprises:

flanges extending laterally from said clip rail;

a bifurcated section of said clamp main body; and upwardly extending daggers on the inward faces of the bifurcated section of the clamp main body;

said clip rail being seated within the inward faces of the bifurcated section of the clamp main body.

4. An insulation system in accordance with claim 2 wherein said means for securing said ceiling panels to said second end of said suspension clip comprises:

a flange on said ceiling panel;

at least one extension depending from said second end of said suspension clip; and a prong depending from said second end of said suspension clip, said prong be disposed to grip said flange between said prong and said extension.

5. A clamp having a first and a second end for use in connecting an insulation supporting ceiling to a twin-vee patio type roof having longitudinal ribs with downwardly open, slots having opposing walls at the apices of said ribs, said clamp comprising:

a diagonal plate on first end of said clamp;

an extended engaging edge on said diagonal plate;

a set screw threadingly engaged through said diagonal plate; with its head facing a second end of said clamp; and a connecting means on the second end of said clamp; and said first end of said clamp being lodged between the opposing walls of said slot at the apices of the roof by engaging said extended edge and said set screw with opposing vertical walls, and connecting the second end of said clamp to the ceiling upon which the insulation rests, thereby suspending the ceiling and the insulation beneath the roof through said clamps.

6. A clamp having a first and second end for use in connecting an insulation supporting ceiling through a slidable hanger assembly to a twin-vee patio type roof having longitudinal ribs with downwardly open walled slots at the apices of said ribs, said clamp comprising:

a diagonal plate on said first end having an extended engaging edge;

a set screw threadingly engaged through said diagonal plate with its head accessible from beneath said clamp;

a front plate connecting said diagonal plate to the second end of said clamp;

side plates strengthening said front plate and said diagonal plate in their angular relationship;

a bifurcated main body of said clamp on said second end; and an array of paired parallel daggers on the inside of said bifurcated main body of said clamp disposed to receive and secure said slidable hanger assembly.

7. An insulation system for use with a twin-vee patio type roof having longitudinal panels with alternating longitudinal ribs and troughs with said ribs rising to apices having downwardly open longitudinal slots with substantially vertical walls, said insulation system comprising:

ceiling panels;

a clamp having a first and second end, said clamp comprising:

a diagonal plate on said first end having an extended engaging edge;

a set screw threadingly engaged through said diagonal plate with its head accessible from beneath said clamp;

a front plate connecting said diagonal plate to the second end of said clamp;

side plates strengthening said front plate and said diagonal plate in their angular relationship;

a bifurcated main body of said clamp on said second end;

an array of paired parallel daggers on the inside of said bifurcated main body of said clamp;

a slideable hanger assembly comprising:

a clip rail securely engagable with said daggers with the bifurcated second end of said clamp;

a receiving track on the underside of said clip rail;

a suspension clip with a first and second end, the first of which is slideably engagable within said receiving track;

fastening means for connecting the second end of said suspension clip to said ceiling panels; and insulation placed within said cavity between said roof and said ceiling panels.

* * * * *

UNITED STATES PATENT AND TRADEMARK OFFICE

CERTIFICATE OF CORRECTION

PATENT NO. : 4,425,747

DATED : January 17, 1984

INVENTOR(S) : WAYNE H. PLAYER

It is certified that error appears in the above-identified patent and that said Letters Patent is hereby corrected as shown below:

In the ABSTRACT, line 16, after "carries", delete "mean" and insert --means--; and In Claim 1, column 4, line 68, after "panels", insert --.--(a period).

Signed and Sealed this

Tenth Day of April 1984

[SEAL]

Attest:

GERALD J. MOSSINGHOFF

Attesting Officer

Commissioner of Patents and Trademarks